US007041340B2

(12) United States Patent
Kittle et al.

(10) Patent No.: US 7,041,340 B2
(45) Date of Patent: May 9, 2006

(54) POWDER COATING PROCESS WITH TRIBOSTATICALLY CHARGED FLUIDIZED BED

(75) Inventors: Kevin Jeffrey Kittle, Co. Durham (GB); Michele Falcone, Como (IT)

(73) Assignee: International Coatings Limited, London (GB)

( * ) Notice: Subject to any disclaimer, the term of this patent is extended or adjusted under 35 U.S.C. 154(b) by 0 days.

(21) Appl. No.: 10/479,722

(22) PCT Filed: Jun. 6, 2002

(86) PCT No.: PCT/GB02/02790

§ 371 (c)(1), (2), (4) Date: Mar. 4, 2004

(87) PCT Pub. No.: WO02/098577

PCT Pub. Date: Dec. 12, 2002

(65) Prior Publication Data

US 2004/0126487 A1 Jul. 1, 2004

(30) Foreign Application Priority Data

Jun. 6, 2001 (GB) ..... 0113783.5

(51) Int. Cl.
*B05D 1/04* (2006.01)

(52) U.S. Cl. ..... 427/459; 427/460; 427/461; 118/634

(58) Field of Classification Search ..... 427/459–461; 118/308, 309, 634
See application file for complete search history.

(56) References Cited

U.S. PATENT DOCUMENTS 3,248,253 A * 4/1966 Barford et al. ..... 427/459
3,396,699 A 8/1968 Beebe et al.
3,670,699 A * 6/1972 Sargent ..... 118/629
3,690,298 A 9/1972 Venturi
3,817,211 A 6/1974 Brown et al.
3,871,328 A 3/1975 English
6,506,455 B1 1/2003 Bru et al.

FOREIGN PATENT DOCUMENTS

WO 99/30838 A1 6/1999
WO 9930838 * 6/1999
WO 00/76677 * 12/2000
WO 00/76677 A1 12/2000

OTHER PUBLICATIONS

Liberto, N.P. (Ed.) Powder Coating The Complete Finisher's Handbook, pp. 88-89, 1994.*

* cited by examiner

*Primary Examiner*—Fred J. Parker
(74) *Attorney, Agent, or Firm*—Oliff & Berridge, PLC

(57) ABSTRACT

A process for forming a coating on a conductive substrate, including the steps of: establishing a fluidised-bed of a powder coating composition, thereby effecting tribostatic charging of the powder coating composition, the fluidised-bed including a fluidising chamber at least a part of which is conductive, applying a voltage to the conductive part of the fluidising chamber, immersing the substrate wholly or partly in the fluidised bed, whereby charged particles of the powder coating composition adhere to the substrate, the substrate being either electrically isolated or earthed, withdrawing the substrate from the fluidised-bed and forming the adherent particles into a continuous coating over at least part of the substrate. The process offers advantages in terms of coating substrate areas which, because of the Faraday cage effect, are inaccessible in conventional electrostatic powder coating processes, and also enables the formation of thinner coatings than are obtainable by conventional fluidised-bed processes.

29 Claims, 2 Drawing Sheets

POWDER COATING PROCESS WITH TRIBOSTATICALLY CHARGED FLUIDIZED BED

Figure 1:
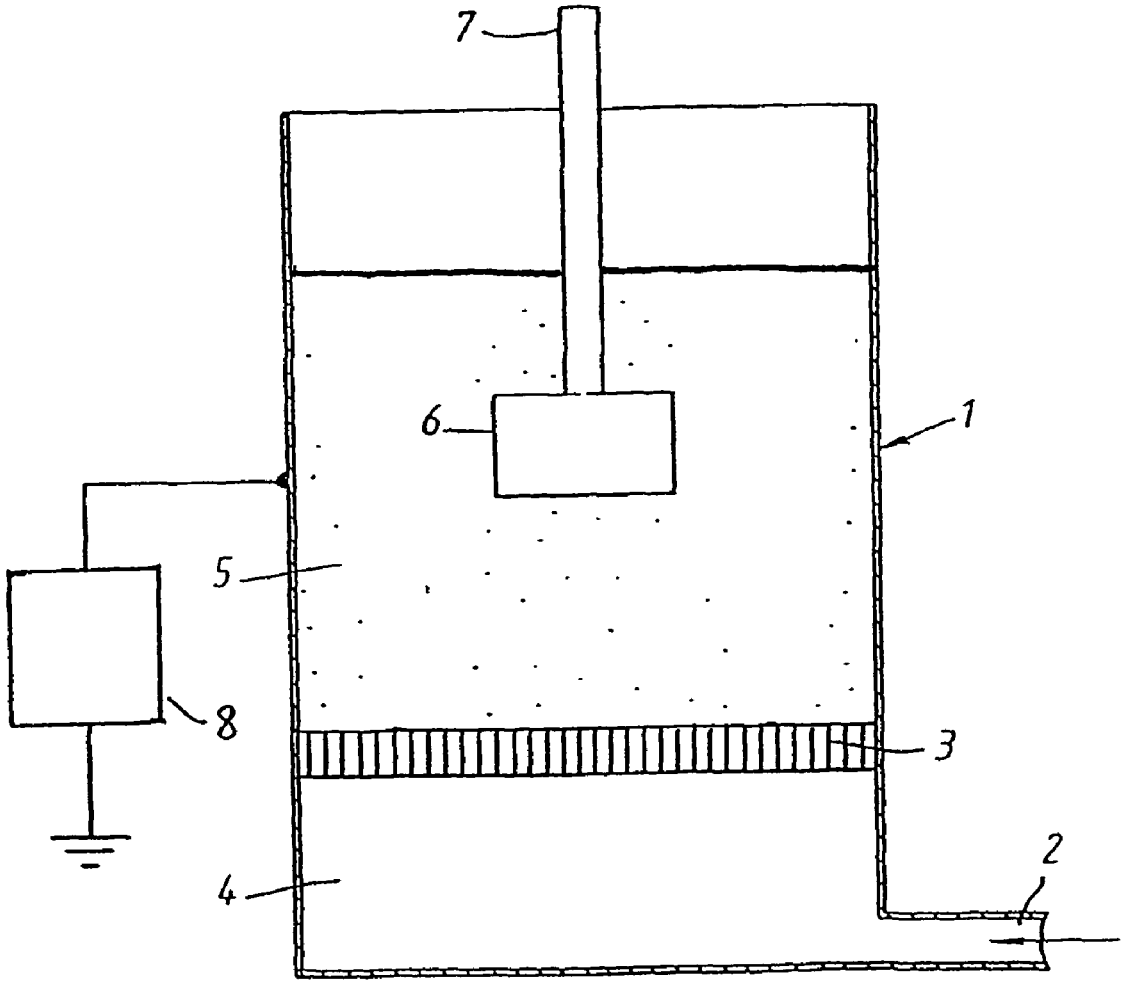

The invention relates to a process for the application of powder coating compositions to substrates.

Powder coatings are solid compositions which are usually applied by an electrostatic application process in which the powder coating particles are electrostatically charged and caused to adhere to a substrate which is usually metallic and electrically earthed. The charging of the powder coating particles is usually achieved by interaction of the particles with ionised air (corona charging) or by friction (triboelectric, tribostatic or "tribo" charging) employing a spray gun. The charged particles are transported in air towards the substrate and their final deposition is influenced, inter alia, by the electric field lines that are generated between the spray gun and the substrate.

A disadvantage of the corona charging process is that there are difficulties in coating substrates having complicated shapes, especially substrates having recessed portions, resulting from restricted access of the electric field lines into recessed locations in the substrate (the Faraday cage effect). The Faraday cage effect is less evident in the case of the tribostatic charging process but that process has other drawbacks.

As an alternative to electrostatic spray processes, powder coating compositions may be applied by processes in which the substrate is preheated (typically to 200° C.–400° C.) and dipped into a fluidised-bed of the powder coating composition. The powder particles that come into contact with the preheated substrate melt and adhere to the surface of the substrate. In the case of thermosetting powder coating compositions, the initially-coated substrate may be subjected to further heating to complete the curing of the applied coating. Such post-heating may not be necessary in the case of thermoplastic powder coating compositions.

Fluidised-bed processes eliminate the Faraday cage effect, thereby enabling recessed portions in the substrate workpiece to be coated, and are attractive in other respects, but are known to have the disadvantage that the applied coatings are substantially thicker than those obtainable by electrostatic coating processes.

Another alternative application technique for powder coating compositions is the so-called electrostatic fluidised-bed process, in which air is ionised by means of charging electrodes arranged in a fluidising chamber or, more usually, in a plenum chamber lying below a porous air-distribution membrane. The ionised air charges the powder particles, which acquire an overall upwards motion as a result of electrostatic repulsion of identically charged particles. The effect is that a cloud of charged powder particles is formed above the surface of the fluidised-bed. The substrate is usually earthed and is introduced into the cloud of powder particles some of which are deposited on the substrate surface by electrostatic attraction. No preheating of the substrate is required in the electrostatic fluidised-bed process.

The electrostatic fluidised-bed process is especially suitable for coating small articles, because the rate of deposition of the powder particles is reduced as the article is moved away from the surface of the charged bed. Also, as in the case of the traditional fluidised-bed process, the powder is confined to an enclosure and there is no need to provide equipment for the recycling and re-blending of over-spray that is not deposited on the substrate. As in the case of the corona-charging electrostatic process, however, there is a strong electric field between the charging electrodes and the substrate and, as a result, the Faraday cage effect operates to a certain extent and leads to poor deposition of powder particles into recessed locations on the substrate.

The present invention provides a process for forming a coating on a conductive substrate, including the steps of:

establishing a fluidised-bed of a powder coating composition, thereby effecting tribostatic charging of the powder coating composition, the fluidised-bed including a fluidising chamber at least a part of which is conductive, applying a voltage to the conductive part of the fluidising chamber, immersing the substrate wholly or partly in the fluidised bed, whereby charged particles of the powder coating composition adhere to the substrate, the substrate being either electrically isolated or earthed, withdrawing the substrate from the fluidised-bed and forming the adherent particles into a continuous coating over at least part of the substrate.

The substrate comprises metal (for example, aluminium or steel) or another conductive material, and may in principle be of any desired shape and size. Advantageously, the substrate is chemically or mechanically cleaned prior to application of the composition, and, in the case of metal substrates, is preferably subjected to chemical pretreatment for example, with iron phosphate, zinc phosphate or chromate.

In the process of the present invention, particles of the powder coating composition adhere to the substrate as a result of the frictional charging (triboelectric, tribostatic or "tribo" charging) of the particles as they rub against one another in circulating in the fluidised bed.

Preferably, the substrate is earthed.

The process of the present invention is conducted without ionisation or corona effects in the fluidised bed.

The voltage applied to the fluidised-bed chamber is sufficient to cause the coating of the substrate by the frictionally charged powder coating particles while resulting in a maximum potential gradient that is insufficient to produce either ionisation or corona effects in the fluidised bed. Air at atmospheric pressure usually serves as the gas in the fluidised bed but other gases may be used, for example, nitrogen or helium.

As compared with the electrostatic fluidised-bed process in which a substantial electric field is generated between charging electrodes and the substrate, the process of the present invention offers the possibility of achieving good coating of substrate areas which are rendered inaccessible by the Faraday cage effect usually evident in conductive substrates.

As compared with traditional fluidised-bed application processes, the process of the invention offers the possibility of applying thinner coatings in a controlled manner since inter-particle charging becomes more effective as particle sizes are reduced.

Improvements in efficiency as particle sizes are reduced stands in contrast with the powder coating process using a triboelectric gun where efficiency falls as particle sizes are reduced.

The uniformity of the coating may be improved by shaking or vibrating the substrate in order to remove loose particles Conversion of the adherent particles into a continuous coating (including, where appropriate, curing of the applied composition) may be effected by heat treatment and/or by radiant energy, notably infra-red, ultra-violet or electron beam radiation. Compared with traditional fluidised-bed application technology, pre-heating of the substrate is not an essential step in the process of the invention and, preferably, there is no preheating of the substrate prior to immersion in the fluidised bed.

Since the voltage applied to the fluidising chamber is insufficient to produce either ionisation or corona effects in the fluidised bed, the fluidising chamber is unlikely to draw any electrical current when the substrate is electrically isolated and, consequently, is unlikely to draw any electrical power when the substrate is electrically isolated. The current drawn is expected to be less than 1 mA when the substrate is electrically earthed.

The voltage applied to the fluidising chamber in the process of the present invention is, preferably, a direct voltage, either positive or negative, but the use of an alternating voltage is possible by, say, applying the voltage intermittently at times when it is positive or at times when it is negative. The applied voltage may vary within wide limits according, inter alia, to the size of the fluidised bed, the size and complexity of the substrate and the film thickness desired. On this basis, the applied voltage will in general be in the range of from 10 volts to 100 kilovolts, more usually from 100 volts to 60 kilovolts, preferably from 100 volts to 30 kilovolts, more especially from 100 volts to 10 kilovolts, either positive or negative. The voltage ranges include 10 volts to 100 volts, 100 volts to 5 kilovolts, 5 kilovolts to 60 kilovolts, 15 kilovolts to 35 kilovolts, 5 kilovolts to 30 kilovolts; 30 kilovolts to 60 kilovolts may also be satisfactory.

A direct voltage may be applied to the fluidising chamber continuously or intermittently and the polarity of the applied voltage may be changed during coating. With intermittent application of the voltage, the fluidising chamber may be electrified before the substrate is immersed in the fluidised bed and not disconnected until after the substrate has been removed from the bed. Alternatively, the voltage may be applied only after the substrate has been immersed in the fluidised-bed. Optionally, the voltage may be disconnected before the substrate is withdrawn from the fluidised-bed. The magnitude of the applied voltage may be varied during coating.

In order to exclude ionisation and corona conditions, the maximum potential gradient existing in the fluidised bed is below the ionisation potential for the air or other fluidising gas. Factors determining the maximum potential gradient include the applied voltage and the spacing between the fluidising chamber and the substrate and other elements of the apparatus.

For air at atmospheric pressure, the ionisation potential gradient is 30 kV/cm, and accordingly the maximum potential gradient using air as fluidising gas at atmospheric pressure should be below 30 kV/cm. A similar maximum potential gradient would also be suitable for use with nitrogen or helium as fluidising gas.

Based on these considerations, the maximum potential gradient existing in the fluidised bed may be 29 kV/cm, 27.5, 25, 20, 15, 10, 5 or 0.05 kV/cm.

The minimum potential gradient will in general be at least 0.01 kV/cm or at least 0.05 kV/cm.

Preferably, the substrate is wholly immersed within the fluidised bed during the coating process.

As is stated above, in the process according to the invention, the charging of the powder particles is effected by friction between particles in the fluidised-bed. The friction between the particles in the fluidised-bed leads to bipolar charging of the particles, that is to say, a proportion of the particles will acquire a negative charge and a proportion will acquire a positive charge. The presence of both positively and negatively charged particles in the fluidised-bed might appear to be a disadvantage, especially when a direct voltage is applied to the fluidising chamber, but the process of the invention is capable of accommodating the bipolar charging of the particles.

In the case in which a direct voltage of a given polarity is applied to the fluidising chamber, electrostatic forces tend to attract powder coating particles of predominantly one polarity onto the substrate. The resulting removal of positively and negatively charged particles at different rates might be expected to lead to a progressive reduction in the proportion of particles of a particular polarity in the body of powder but it is found that, in practice, the remaining powder particles adjust their relative polarities as depletion progresses and charge-balance is maintained.

The preferred period of immersion of the substrate with the fluidising chamber in a charged condition will depend on the size and geometrical complexity of the substrate, the film thickness required, and the magnitude of the applied voltage, being generally in the range of from 10 milliseconds to 10, 20 or 30 minutes, usually 500 milliseconds to 5 minutes, more especially from 1 second to 3 minutes.

Preferably, the substrate is moved in a regular or intermittent manner during its period of immersion in the fluidised bed. The motion may, for example, be linear, rotary and/or oscillatory. As is indicated above, the substrate may, additionally, be shaken or subjected to vibration in order to remove particles adhering only loosely to it. As an alternative to a single immersion, the substrate may be repeatedly immersed and withdrawn until the desired total period of immersion has been achieved.

The pressure of the fluidising gas (normally air) will depend on the bulk of the powder to be fluidised, the fluidity of the powder, the dimensions of the fluidised bed, and the pressure difference across the porous membrane.

The particle size distribution of the powder coating composition may be in the range of from 0 to 150 microns, generally up to 120 microns, with a mean particle size in the range of from 15 to 75 microns, preferably at least 20 to 25 microns, advantagoeusly not exceeding 50 microns, more especially 20 to 45 microns.

Finer size distributions may be preferred, especially where relatively thin applied films are required, for example, compositions in which one or more of the following criteria is satisfied:

a) 95–100% by volume<50 μm
b) 90–100% by volume<40 μm
c) 45–100% by volume<20 μm
d) 5–100% by volume<10 μm preferably 10–70% by volume<10 μm
e) 1–80% by volume<5 μm preferably 3–40% by volume<5 μm
f) $d(v)_{50}$ in the range 1.3–32 μm preferably 8–24 μm $D(v)_{50}$ is the median particle size of the composition. More generally, the volume percentile $d(v)_x$ is the percentage of the total volume of the particles that lies below the stated particle size d. Such data may be obtained using the Mastersizer X laser light-scattering device manufactured by Malvern instruments. If required, data relating to the particle size distribution of the deposited material (before bake/cure) can be obtained by scraping the adhering deposit off the substrate and into the Mastersizer.

The thickness of the applied coating may be in the range of from 5 to 500 microns or 5 to 200 microns or 5 to 150 microns, more especially from 10 to 150 microns, for example from 20 to 100 microns, 20 to 50 microns, 25 to 45 microns, 50 to 60 microns, 60 to 80 microns or 80 to 100 microns or 50 to 150 microns. The principal factor affecting the thickness of the coating is the applied voltage, but the duration of the period of immersion with the fluidising chamber in a charged condition and fluidising air pressure also influence the result, In general, the coating process of the invention may be characterised by one or more of the following features:

(i) The coating process is three dimensional and capable of penetrating recesses.

(ii) The applied voltage and the spacing between the substrate and the fluidising chamber are selected so that the maximum potential gradient is below the ionisation potential gradient for the air or other fluidising gas. There are accordingly substantially no ionisiation or corona effects.

(iii) The thickness of the powder coating increases as the voltage applied to the fluidising chamber increases. The increase in thickness is achievable without loss of quality up to a point but a progressive loss of smoothness is eventually seen.

(iv) Coating is achievable at room temperature.

(v) Uniform coating on the substrate is achievable irrespective of whether the coating is in a recess, on a projection or on a flat surface of the substrate.

(vi) Smooth coated edges are obtainable.

(vii) Good quality powder coating is achievable in terms of smoothness and the absence of pitting or lumpiness.

(viii) As compared with a fluidised-bed triboelectric process in which a voltage is applied to the substrate, more extensive and consistent coverage is achievable, and good coverage can be achieved more quickly.

(ix) The process is suitable for coating wire which is subsequently coiled and also for coil (metal sheet) coating because of speed of coating and the absence of electrification of the substrate.

The process is effective to powder coat a conductive substrate of any shape. The substrate is, preferably, earthed although it may be electrically isolated, that is, without an electrical connection (substrate electrically "floating", that is, its electrical potential is indeterminate).

The spacing between the substrate and the fluidising chamber is about the same as for the fluidised-bed triboelectric process in which a voltage is applied to the substrate so potential gradients are comparable to that process, that is, well below the ionisation potential for the fluid (most usually air) used in the apparatus.

The process of the invention offers particular benefits in the automotive and other fields where it is desired to coat an article such as a car body at sufficient film build to provide adequate cover for any metal defects before applying an appropriate topcoat. According to previous practice, it has been necessary to apply two separate coats to such articles in order to provide proper preparation for the topcoat. Thus, it has been common practice to apply a first coating of an electropaint to give a barrier film over the whole metal surface, followed by a second coating of a primer surfacer to ensure proper covering of any visible defects. By contrast, the present invention offers the possibility of achieving adequate protective and aesthetic coverage, even of articles of complex geometry, by means of a single coating applied by the process of the invention. Also, the coating process can be adapted to produce relatively high film thickness in a single operation if required.

The invention accordingly also provides a process for coating automotive components, in which a first coating derived from a powder coating composition is applied by means of the process of the invention as herein defined, and thereafter a topcoat is applied over the powder coating.

Mention should also be made of applications of the process of the invention in the aerospace industry, where it is of particular advantage to be able to apply uniform coatings at minimum film weights to substrates (especially aluminium or aluminium-alloy substrates) of a wide range of geometric configurations in an environmentally-compliant manner.

The process of the invention is capable of dealing with articles such as radiators, wire baskets and freezer shelves which include welds and projections, providing a uniform coating of powder on the welds and projections as well as on the remainder of the articles, without over-covering of the projections.

The invention is especially suitable for powder coating wire or sheet metal each of which is advantageously in coil form, because of the absence of an electrical connection to the substrate and the speed of powder coating that is achieved.

The invention further provides apparatus for use in carrying out the process of the invention, which comprises:

(a) a fluidising chamber a part of which, at least, is electrically conductive, (b) means for fluidising a powder coating composition within the fluidising chamber so as to establish a fluldised bed of the powder coating composition, thereby effecting tribostatic charging of the powder coating composition, (c) means for immersing a conductive substrate wholly or partly within the fluidised bed, the substrate being either electrically isolated or earthed, (d) means for applying a voltage to the electrically conductive part of the fluidising chamber for at least part of the period of immersion of the substrate, whereby charged particles of the powder coating composition adhere to the substrate, (e) means for withdrawing the substrate bearing adherent particles from the fluidised bed and (f) means for converting the adherent particles into a continuous coating.

A powder coating composition according to the invention may contain a single film-forming powder component comprising one or more film-forming resins or may comprise a mixture of two or more such components.

The film-forming resin (polymer) acts as a binder, having the capability of wetting pigments and providing cohesive strength between pigment particles and of wetting or binding to the substrate, and melts and flows in the curing/stoving process after application to the substrate to form a homogeneous film.

The or each powder coating component of a composition of the invention will in general be a thermosetting system, although thermoplastic systems (based, for example, on polyamides) can in principle be used instead.

When a thermosetting resin is used, the solid polymeric binder system generally includes a solid curing agent for the thermosetting resin; alternatively two co-reactive film-forming thermosetting resins may be used.

The film-forming polymer used in the manufacture of the or each component of a thermosetting powder coating composition according to the invention may be one or more selected from carboxy-functional polyester resins, hydroxy-functional polyester resins, epoxy resins, and functional acrylic resins.

A powder coating component of the composition can, for example, be based on a solid polymeric binder system comprising a carboxy-functional polyester film-forming resin used with a polyepoxide curing agent. Such carboxy-functional polyester systems are currently the most widely used powder coatings materials. The polyester generally has an acid value in the range 10–100, a number average molecular weight Mn of 1,500 to 10,000 and a glass transition temperature Tg of from 30° C. to 85° C., preferably at least 40° C. The poly-epoxide can, for example, be a low molecular weight epoxy compound such as triglycidyl isocyanurate (TGIC), a compound such as diglycidyl terephthalate condensed glycidyl ether of bisphenol A or a light-stable epoxy resin. Such a carboxy-functional polyester film-forming resin can alternatively be used with a bis(beta-hydroxyalkylamide) curing agent such as tetrakis(2-hydroxyethyl) adipamide.

Alternatively, a hydroxy-functional polyester can be used with a blocked isocyanate-functional curing agent or an amine-formaldehyde condensate such as, for example, a melamine resin, a urea-formaldehye resin, or a glycol ural formaldehye resin, for example the material "Powderlink 1174" supplied by the Cyanamid Company, or hexahydroxymethyl melamine. A blocked isocyanate curing agent for a hydroxy-functional polyester may, for example, be internally blocked, such as the uretdione type, or may be of the caprolactam-blocked type, for example isophorone diisocyanate.

As a further possibility, an epoxy resin can be used with an amine-functional curing agent such as, for example, dicyandiamide. Instead of an amine-functional curing agent for an epoxy resin, a phenolic material may be used, preferably a material formed by reaction of epichlorohydrin with an excess of bisphenol A (that is to say, a polyphenol made by adducting bisphenol A and an epoxy resin). A functional acrylic resin, for example a carboxy-, hydroxy- or epoxy-functional resin can be used with an appropriate curing agent.

Mixtures of film-forming polymers can be used, for example a carboxy-functional polyester can be used with a carboxy-functional acrylic resin and a curing agent such as a bis(beta-hydroxyalkylamide) which serves to cure both polymers. As further possibilities, for mixed binder systems, a carboxy-, hydroxy- or epoxy-functional acrylic resin may be used with an epoxy resin or a polyester resin (carboxy- or hydroxy-functional). Such resin combinations may be selected so as to be co-curing, for example a carboxy-functional acrylic resin co-cured with an epoxy resin, or a carboxy-functional polyester co-cured with a glycidyl-functional acrylic resin. More usually, however, such mixed binder systems are formulated so as to be cured with a single curing agent (for example, use of a blocked isocyanate to cure a hydroxy-functional acrylic resin and a hydroxy-functional polyester). Another preferred formulation involves the use of a different curing agent for each binder of a mixture of two polymeric binders (for example, an amine-cured epoxy resin used in conjunction with a blocked isocyanate-cured hydroxy-functional acrylic resin).

Other film-forming polymers which may be mentioned include functional fluoropolymers, functional fluorochloropolymers and functional fluoroacrylic polymers, each of which may be hydroxy-functional or carboxy-functional, and may be used as the sole film-forming polymer or in conjunction with one or more functional acrylic, polyester and/or epoxy resins, with appropriate curing agents for the functional polymers.

Other curing agents which may be mentioned include epoxy phenol novolacs, and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclobexylmethane diisocyanate curing agent) blocked with methyl ethyl ketoxime; light-stable epoxy resins such as "Santolink LSE 120" supplied by Monsanto; and alicyclic poly-epoxides such as "EHPE-3150" supplied by Daicel.

A powder coating composition for use according to the invention may be free from added colouring agents, but usually contains one or more such agents (pigments or dyes). Examples of pigments which can be used are inorganic pigments such as titanium dioxide, red and yellow iron oxides, chrome pigments and carbon black and organic pigments such as, for example, phthalocyanine, azo, anthraquinone, thioindigo, isodibenzanthrone, triphendioxane and quinacridone pigments, vat dye pigments and lakes of acid, basic and mordant dyestuffs. Dyes can be used instead of or as well as pigments.

The composition of the invention may also include one or more extenders or fillers, which may be used inter alia to assist opacity, whilst minimising costs, or more generally as a diluent.

The following ranges should be mentioned for the total pigment/filler/extender content of a powder coating composition according to the invention (disregarding post-blend additives):

0% to 55% by weight,

0% to 50% by weight,

10% to 50% by weight,

0% to 45% by weight, and

25% to 45% by weight

Of the total pigment/filler/extender content, the pigment content will generally be ≦40% by weight of the total composition (disregarding post-blend additives) but proportions up to 45% or even 50% by weight may also be used. Usually a pigment content of 25 to 30 or 35% is used, although in the case of dark colours opacity can be obtained with <10% by weight of pigment.

The composition of the invention may also include one or more performance additives, for example, a flow-promoting agent, a plasticiser, a stabiliser, e.g. against UV degradation, or an anti-gassing agent, such as benzoin, or two or more such additives may be used. The following ranges should be mentioned for the total performance additive content of a powder coating composition according to the invention (disregarding post-blend additives):

0% to 5% by weight,

0% to 3% by weight, and

1% to 2% by weight.

In general, colouring agents, fillers/extenders and performance additives as described above will not be incorporated by post-blending, but will be incorporated before and/or during the extrusion or other homogenisation process.

After application of the powder coating composition to a substrate, conversion of the resulting adherent particles into a continuous coating (including, where appropriate, curing of the applied composition) may be effected by heat treatment and/or by radiant energy, notably infra-red, ultra-violet or electron beam radiation.

The powder is usually cured on the substrate by the application of heat (the process of stoving); the powder particles melt and flow and a film is formed. The curing times and temperatures are interdependent in accordance with the composition formulation that is used, and the following typical ranges may be mentioned:

| Temperature/° C. | Time |
|---|---|
| 280 to 100* | 10 s to 40 min |
| 250 to 150 | 15 s to 30 min |
| 220 to 160 | 5 min to 20 min |

*Temperatures down to 90° C. may be used for some resins, especially certain epoxy resins.

The powder coating composition may incorporate, by post-blending, one or more fluidity-assisting additives, for example, those disclosed in WO 94/11446, and especially the preferred additive combination disclosed in that Specification, comprising aluminium oxide and aluminium hydroxide, typically used in proportions in the range of from 1:99 to 99:1 by weight, advantageously from 10:90 to 90:10, preferably from 20:80 to 80:20 or 30:70 to 70:30, for example, from 45:55 to 55:45. Other combinations of the inorganic materials disclosed as post-blended additives in WO 94/11446 may in principle also be used in the practice of the present invention, for example, combinations including silica. Aluminium oxide and silica may in addition be mentioned as materials which can be used singly as post-blended additives. Mention may also be made of the use of wax-coated silica as a post-blended additive as disclosed in WO 00/01775, including combinations thereof with aluminium oxide and/or aluminium hydroxide.

The total content of post-blended additive(s) incorporated with the powder coating composition will in general be in the range of from 0.01% to 10% by weight, preferably at least 0.1% by weight and not exceeding 1.0% by weight (based on the total weight of the composition without the additive(s)). Combinations of aluminium oxide and aluminium hydroxide (and similar additives) are advantageously used in amounts in the range of from 0.25 to 0.75% by weight, preferably 0.45 to 0.55%, based on the weight of the composition without the additives. Amounts up to 1% or 2% by weight may be used, but problems can arise if too much is used, for example, bit formation and decreased transfer efficiency.

The term "post-blended" in relation to any additive means that the additive has been incorporated after the extrusion or other homogenisation process used in the manufacture of the powder coating composition.

Post-blending of an additive may be achieved, for example, by any of the following dry-blending methods:

a) tumbling into the chip before milling;
b) injection at the mill;
c) introduction at the stage of sieving after milling;
d) post-production blending in a "tumbler" or other suitable mixing device; or
e) introduction into the fluidised bed.

Figure 2:
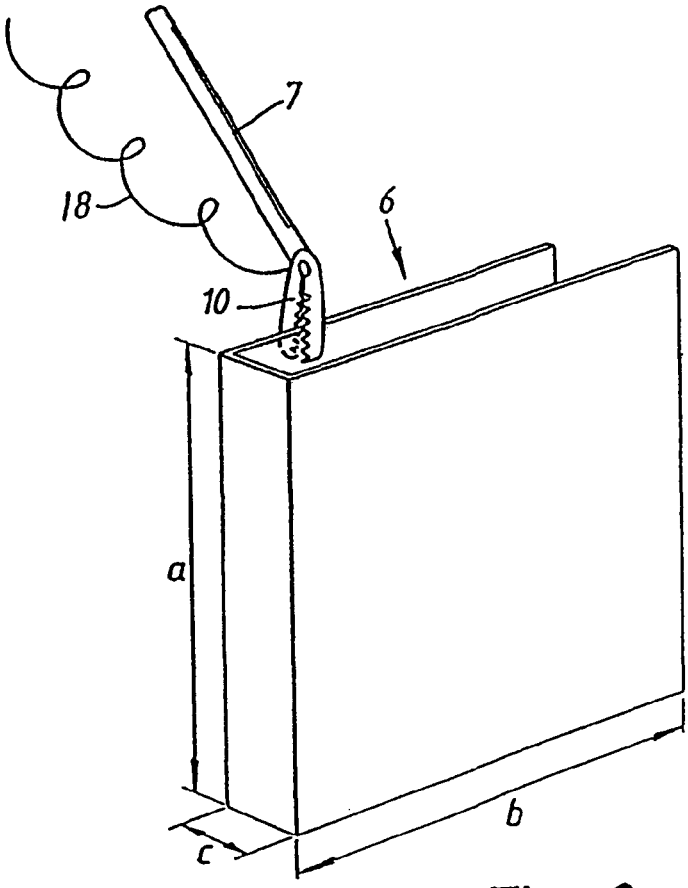
Figure 3:
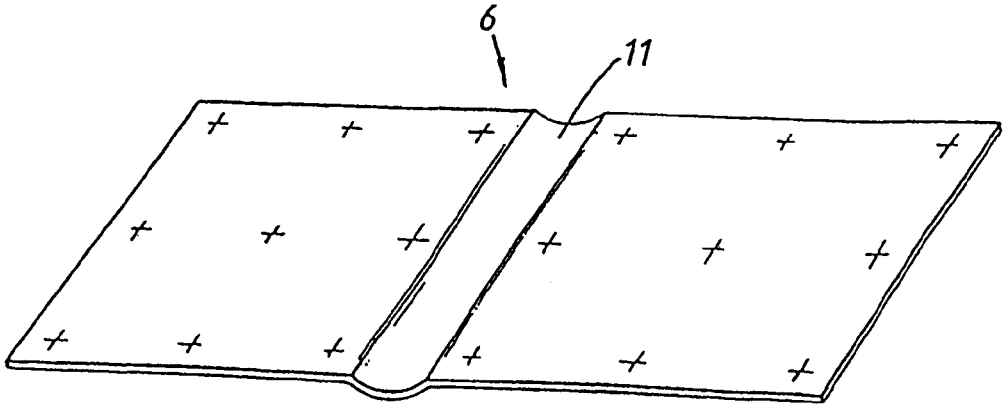

A general form of fluidised-bed triboelectric powder coating apparatus suitable for carrying out a process in accordance with the invention and several forms of process in accordance with the invention will now be described, by way of example only, with reference to the accompanying drawings, in which:

FIG. 1 shows the general form of fluidised-d triboelectric powder coating apparatus in diagrammatic section, FIG. 2 is a perspective representation of a conductive metal substrate as used in the Example; and FIG. 3 is a perspective view of the substrate of FIG. 2 in a flattened-out condition for the purpose of evaluating the film thickness and percentage coverage achieved in the Example.

Referring to FIG. 1 of the accompanying drawings, the fluidised-bed triboelectric powder coating apparatus includes a fluidising chamber (1) having an air inlet (2) at its to base and a porous air distribution membrane (3) disposed transversely so as to divide the chamber into a lower plenum (4) and an upper fluidising compartment (5).

In operation, a substrate (6) having an insulated support (7), preferably a rigid support, is immersed in a fluidised bed of a powder coating composition established in the fluidising compartment (5) by means of an upwardly-flowing stream of air introduced from the plenum (4) through the porous membrane (3).

For at least part of the period of immersion, a direct voltage is applied to the fluidising chamber (1) by means of a variable voltage source (8). The particles of the powder coating composition become electrically charged as a result of triboelectric action among the particles. As shown, the substrate (6) has no electrical connection (electrically "floating") but it may instead be earthed by a suitable electrical connection. Triboelectrically charged particles of the powder coating composition adhere to the substrate (6). There are no ionisation or corona effects, the voltage supplied by the voltage source (8) being kept below the level required to generate such effects. A metal substrate is preferably earthed.

The substrate (6) may be moved in a regular oscillatory manner during the coating process by means not shown in FIG. 1. Alternatively, the substrate may be advanced through the bed either intermittently or continuously during immersion, or may be repeatedly immersed and withdrawn until a desired total period of immersion has been achieved. There is also the possibility of keeping the substrate still and moving the powder by vibrating the bed or stirring the bed with a propeller mixer.

After the desired period of immersion the substrate is withdrawn from the fluidised bed and is heated so as to melt and fuse the adhering particles of the powder coating composition and complete the coating.

The voltage source (8) is mains-powered and the output voltage is measured relative to mains earth potential.

The following Example illustrates the process of the invention, and was carried out using apparatus as shown in FIG. 1 with a fluidisation unit supplied by the Nordson Corporation having a generally cylindrical chamber (1) of height 25 cm and diameter 15 cm.

In the Example, the substrate (6) was mounted on an insulating support (7) in the form of a rod of length 300 mm. The substrate was positioned centrally within the fluidising unit, giving rise to a maximum potential gradient that is expected to be no more than 3 kV/cm when a voltage of 3 kV is applied to the fluidising chamber (1). That is, satisfactory results are obtained for potential gradients well below the ionisation potential which is 30 kV/cm for air. It will be evident that the substrate would need to be much closer than it is to the wall of the fluidising unit in order for the maximum potential gradient to be 30 kV/cm when a voltage of 3 kV (the maximum used) is applied to the fluidising chamber. The maximum potential gradient when the voltage used is 0.5 kV, is estimated at 0. 13 kV/cm, and at a voltage of 0.2 kV the estimated maximum potential gradient is about 0.05 kV/cm. Allowing for the oscillation or the vibration of the substrate, it is expected that satisfactory results would be obtained in conditions providing maximum potential gradients in the range 0.05 kV/cm to 1 kV/cm, probably 0.05 kV/cm to 5 kV/cm and, possibly, 0.05 kV/cm to 10 kV/cm.

All dip times reported in the Example are in seconds.

Referring to FIG. 2, the conductive metal substrate 6 used in the Example is an aluminium panel so folded as to be U-shaped in plan view (providing a central recess) and has dimensions as follows:

a=10 cm
b=7.5 cm
c=5 mm.

The substrate 6 is held by a metal clip 10 mounted on an arm 7. The substrate is earthed by way of a conductor 18.

FIG. 3 is a perspective view of the substrate 6 in flattened-out condition for the purpose of evaluating the film thickness and percentage coverage achieved in the process of the Example.

Two powder coating compositions designated A and B were prepared in conventional manner by extrusion, kibbling into chip form, and milling.

The formulation of each composition was as follows:

| | Parts by weight |
|---|---|
| Rutile Titanium Dioxide | 321 |
| Filler (dolomite) | 107 |
| Carboxylic Acid-Functional Polyester Resin | 374 |
| Epoxy Resin Curing Agent | 152 |
| Catalyst | 30 |
| Wax | 3 |
| Flow modifier | 10 |
| Benzoin | 3 |
| TOTAL | 1000 |

Composition A had a larger maximum particle size than composition B.

The general operating conditions were as follows:

| | |
|---|---|
| Weight of the powder loaded in the bed: | 700–800 g |
| Free fluidisation time for equilibrating the bed: | 30 min. at 0.5 bar |
| Standard bake and cure of deposited material | 15 min. at 180 C. |

The results obtained are summarised in the following Table:

| Coating system | Applied Voltage, Volts | P, bar | Dip-time, sec | INcov, % | OUTcov, % | Thickness, IN, μm | STDEV-IN | Thickness, OUT, μm | STDEV-OUT |
|---|---|---|---|---|---|---|---|---|---|
| A | −3000 | 3 | 300 | 100 | 100 | 60.4 | 13.9 | 74.4 | 35.1 |
| A | −2000 | 3 | 300 | 85 | 100 | 49.3 | 12.1 | 70.1 | 28.3 |
| A | +3000 | 3 | 500 | 100 | 100 | 57.3 | 11.2 | 69.8 | 25.1 |
| B | −2000 | 3 | 120 | 88 | 100 | 49.3 | 12.1 | 69.0 | 17.8 |
| B | −2000 | 3 | 180 | 100 | 100 | 65.1 | 13.2 | 91.2 | 15.1 |
| B | −2000 | 5 | 120 | 100 | 100 | 57.5 | 15.3 | 69.0 | 14.3 |
| B | −3000 | 2 | 90 | 100 | 100 | 70.0 | 14.8 | 90.5 | 16.7 |
| B | +2000 | 3 | 300 | 100 | 100 | 46.9 | 12.1 | 65.7 | 11.8 |
| B | +2000 | 3 | 150 | 51 | 95 | 45.0 | 11.4 | 63.0 | 10.3 |

Film thickness measurements on the U-shaped substrate of FIG. 2 are carried out by first flattening the substrate as shown in FIG. 3, allowing access to all parts of the substrate including the central recess 11. Film thickness measurements are taken at each of the points marked 'X' in FIG. 3 on both the obverse and reverse of the flattened panel, giving a total of 18 readings for each face and a total of 36 readings for the whole panel.

The abbreviations used in the above Table are as follows:

Thickness IN is the average of the film thickness measurements carried out on the inner faces of the substrate.

STDEV-IN is the standard deviation of the film thickness measurements carried out on the inner faces of the substrate.

Thickness OUT is the average of the film thickness measurements carried out on the outer faces of the substrate.

STDEV-OUT is the standard deviation of the film thickness measurements carried out on the inner faces of the substrate.

INcov is the coverage in the recessed surface (inner faces) of the substrate and is assessed visually.

OUTcov is the coverage in the outer surface (outer faces) of the substrate and is assessed visually.

The invention claimed is:

1. A process for forming a coating on a conductive substrate, including the steps of:

establishing a fluidised-bed of a powder coating composition, thereby effecting tribostatic charging of the powder coating composition, the fluidised-bed including a fluidisation gas in a fluidising chamber at least a part of which is conductive, applying a voltage to the conductive part of the fluidising chamber to allow the powder coating to coat the substrate, immersing the substrate wholly or partly in the fluidised bed, whereby tribostatically charged particles of the powder coating composition adhere to the substrate, the substrate being either electrically isolated or earthed, withdrawing the substrate from the fluidised-bed and forming the adherent particles into a continuous coating over at least part of the substrate, the process being conducted without ionisation or corona effects of the fluidisation gas.

2. A process as claimed in claim 1, wherein there is no preheating of the substrate prior to immersion in the fluidised bed.

3. A process as claimed in claim 1, wherein the applied voltage is a DC voltage.

4. A process as claimed in claim 3, wherein the voltage is a positive voltage.

5. A process as claimed in claim 3, wherein the voltage is a negative voltage.

6. A process as claimed in claim 1, wherein the applied voltage is such that the maximum potential gradient existing in the fluidised bed lies below the ionisation potential gradient for the gas in the fluidised bed.

7. A process as claimed in claim 1, wherein the maximum potential gradient existing in the fluidised bed is 29 kV/cm.

8. A process as claimed in claim 1, wherein the potential gradient existing in the fluidised bed is at least 0.01 kV/cm.

9. A process as claimed in claim 1, wherein the applied voltage is in the range of from 10 V to 100 kV.

10. A process as claimed in claim 9, wherein the applied voltage is in the range of from 100 V to 60 kV.

11. A process as claimed in claim 9, wherein the applied voltage is in the range of from 100 V to 30 kV.

12. A process as claimed in claim 9, wherein the applied voltage is in the range of from 100 V to 10 kV.

13. A process as claimed in claim 1, wherein the substrate comprises metal.

14. A process as claimed in claim 13, wherein the substrate is a length of metal wire.

15. A process as claimed in claim 13, wherein the substrate is a metal sheet.

16. A process as claimed in claim 1, wherein the period of immersion of the substrate with the fluidising chamber in a charged condition is up to 30 minutes.

17. A process as claimed in claim 1, wherein the period of immersion of the substrate with the fluidising chamber in a charged condition is at least 10 milliseconds.

18. A process as claimed in claim 1, wherein the thickness of the applied coating is up to 500 microns.

19. A process as claimed in claim 1, wherein the thickness of the applied coating is at least 5 microns.

20. A process as claimed in claim 19, wherein the thickness of the applied coating is in the range of from 20 to 50 microns.

21. A process as claimed in claim 1, wherein the substrate is shaken or vibrated to remove loose particles.

22. A process as claimed in claim 1, wherein the powder coating composition is a thermosetting system.

23. A process as claimed in claim 22, wherein a film-forming polymer in each powder coating component of the powder coating composition is one or more selected from carboxy-functional polyester resins, hydroxy-functional polyester resins, epoxy resins and functional acrylic resins.

24. A process as claimed in claim 1, wherein the powder coating composition is a thermoplastic system.

25. A process as claimed in claim 1, wherein the powder coating composition incorporates, by post blending, one or more fluidity-assisting additives.

26. A process as claimed in claim 25, wherein the powder coating composition incorporates a combination of alumina and aluminium hydroxide as a fluidity-assisting additive.

27. A process as claimed in claim 1, wherein the substrate is wholly immersed within the fluidised bed.

28. An apparatus for carrying out the process of the invention which comprises:

a fluidising chamber, a part of which at least is electrically conductive, the fluidising chamber comprising a fluidisation gas;

means for fluidising a powder coating composition within the fluidising chamber so as to establish a fluidised bed of the powder coating composition, thereby effecting tribostatic charging of the powder coating composition without ionisation or corona effects on the fluidisation gas in the fluidised bed, means for immersing a conductive substrate wholly or partly within the fluidised bed, the substrate being either electrically isolated or earthed, means for applying a voltage to the electrically conductive part of the fluidising chamber for at least part of the period of immersion of the substrate, whereby charged particles of the powder coating composition adhere to the substrate, and the voltage results in a potential gradient that is insufficient to produce ionization and corona effects on the fluidisation gas in the fluidised bed, means for withdrawing the substrate bearing adherent particles from the fluidised bed and means for converting the adherent particles into a continuous coating.

29. An apparatus as claimed in claim 28, which includes means for shaking or vibrating the substrate to remove loose powder particles.

* * * * *

UNITED STATES PATENT AND TRADEMARK OFFICE

CERTIFICATE OF CORRECTION

PATENT NO. : 7,041,340 B2
APPLICATION NO. : 10/479722
DATED : May 9, 2006
INVENTOR(S) : Kevin Jeffrey Kittle and Michele Falcone It is certified that error appears in the above-identified patent and that said Letters Patent is hereby corrected as shown below:

Col. 9, line 60, change "fluidised-d" to --fluidised-bed--.

Signed and Sealed this

Twenty-ninth Day of August, 2006

JON W. DUDAS
*Director of the United States Patent and Trademark Office*